United States Patent [19]

Dezura

[11] 4,077,072

[45] Mar. 7, 1978

[54] SHOWER BATH CURTAIN HOLDER

[76] Inventor: Waldo Dezura, 235 Keith Rd., West, Apt. 601, Vancouver, B. C., Canada

[21] Appl. No.: 706,286

[22] Filed: Jul. 19, 1976

[51] Int. Cl.[2] ..... A47K 3/14; A47K 3/22

[52] U.S. Cl. ..... 4/149; 4/154; 160/349 R

[58] Field of Search ..... 4/145, 146, 148, 149, 4/154, 155; 160/349

[56] References Cited

U.S. PATENT DOCUMENTS

| | | | |
|---|---|---|---|
| 2,424,537 | 7/1947 | Aronheim | 4/148 |
| 2,771,945 | 11/1956 | Wittrup | 4/149 X |
| 2,864,096 | 12/1958 | Garber | 4/149 |
| 3,639,919 | 2/1972 | White | 4/149 |
| 3,808,610 | 5/1974 | Mortensen | 4/149 |
| 3,855,642 | 12/1974 | Blitch | 160/349 X |
| 3,879,806 | 4/1975 | Armstrong | 4/149 X |
| 3,952,337 | 4/1976 | Hansow | 4/148 |

FOREIGN PATENT DOCUMENTS

| | | | |
|---|---|---|---|
| 903,954 | 11/1970 | Canada | 4/148 |

*Primary Examiner*—Richard E. Aegerter
*Assistant Examiner*—Stuart S. Levy
*Attorney, Agent, or Firm*—Cushman, Darby & Cushman

[57] ABSTRACT

A device for releasably securing to a bath tub compartment at least one end of a shower curtain is arranged such that the part of the shower curtain near one vertical edge thereof is not only secured to the generally vertical wall of the compartment; at least a part of the front portion is also secured to the horizontal rim of a bath tub. The curtain thus forms, on releasably fixing same to the compartment, a corner envelope which effectively prevents undesired escape of shower water. The advance in the art resides in a simple structure, in facilitating the application of the overall assembly and in a increased safety and improved appearance of the members of the device secured to the bath tub compartment wall.

6 Claims, 8 Drawing Figures

SHOWER BATH CURTAIN HOLDER

The present invention relates to shower bath compartments and in particular to a shower batch curtain guard.

Shower bath curtains are often used with bath tubs to convert the bath tub compartment into a shower compartment. The curtains are suspended at a suitable height above the outside rim of a bath tub with the lower edge of the curtain placed inside the bath tub and with its end edges being located against to the end walls of the compartment. It is well known that the above arrangement suffers from the drawback of the shower water escape through an area of corners defined by the bath tub rim and the end walls of the compartment.

Different attempts have been made to solve the above problem. Thus, Canadian Pat. No. 903,954 issued July 4, 1972 to R. J. Sparling proposes the use of a member of L-shaped cross-section having horizontal and vertical arms with continuous depending skirts along the edge of each arm. The member has sealing means for securing one arm to the rim and the other arm to the adjacent wall such as to provide a water-tight seal between guard rim and wall. The guard rim is relatively difficult to secure to the wall and to the bath tub rim. Moreover, it does not actually assist in maintaining the spread or extended curtain in a generally vertical position in contact with the end wall. Another solution is proposed in U.S. Pat. No. 3,808,610 issued May 7, 1974 to D. Mortensen. Mortensen makes use of interlocking fiber tab means, also known under the trade name "VELCRO". The proposal by Mortensen is advantageous over Sparling in that the sample "VELCRO" fastener means assists in maintaining the shower curtain in the desired generally vertical position. However, on the other hand, the solution of Mortensen requires a generally vertical, rail of L-shaped cross-section fixedly secured to the end wall of the shower compartment, with the appropriate part of the VELCRO fastener secured to the free arm of the rail. The rail is relatively long and difficult to secure to the wall. Moreover, the Mortensen arrangement requires a special "dam" or block secured to the top of the rim of the bath tub. Therefore, even though Mortensen constitutes an improvement in the overall operation of the device, it still suffers from the drawback of a complex arrangement which is bulky and expensive to provide and to install. The common drawback of the known devices of this type is that the basic approach of prior art is in providing a rigid skirt section protruding both from the wall and from the tub rim near the corner between the two. The rigid protruding skirt or rim is undesirable from the standpoint of safety, notwithstanding the drawbacks as referred to above.

It is an object of the present invention to provide a device of the above type which would possess the advantages of the above proposals and which would be generally free of their disadvantages. In particular, the object of the present invention is to provide a device of the above type which can be easily installed, which is relatively inexpensive to produce and which effectively prevents the shower water from escaping through the corner between the bath tub rim and the end wall, at the same time avoiding any rigid skirts or the like protruding from the walls of the tub rim.

The device of the present invention is based on recognition of the fact that the vital corner between the wall and the tub rim through which water normally escapes can effectively be protected from such escape if provisions are made for releasably securing the curtain both to the wall and to a portion of the tub rim such the curtain itself forms a corner-shaped configuration which effectively prevents escape of virtually any water from the shower compartment.

According to the invention a device is provided for preventing water escape from a shower compartment by releasably securing at least one end of a shower curtain to a bath tub compartment wall, the device being of the type utilizing interlocking fiber tab means whose part is secured to the curtain and the second part is fixedly secured to the wall of the compartment. The device comprises holder means for securing to the wall the second part of the tab means. The holder means includes an elongated, flat, flexible holder member having a top surface provided with at least a portion of said second tab means. The holder member has a base surface provided with means for adhesively securing the base surface to selected portions of the compartment. The base surface has a first section including means for securing the first section to the wall along a generally upright line. A second section of the member is arranged for securing the second section in a generally horizontal position to the adjacent portion of the rim of the bath tub. A third section of said holder member is arranged to be located in the corner between the wall and the rim and to be secured to such corner.

The invention will now be described in greater detail with reference to the accompanying drawings. In the drawings.

Figures 1, 2, 3, 4:
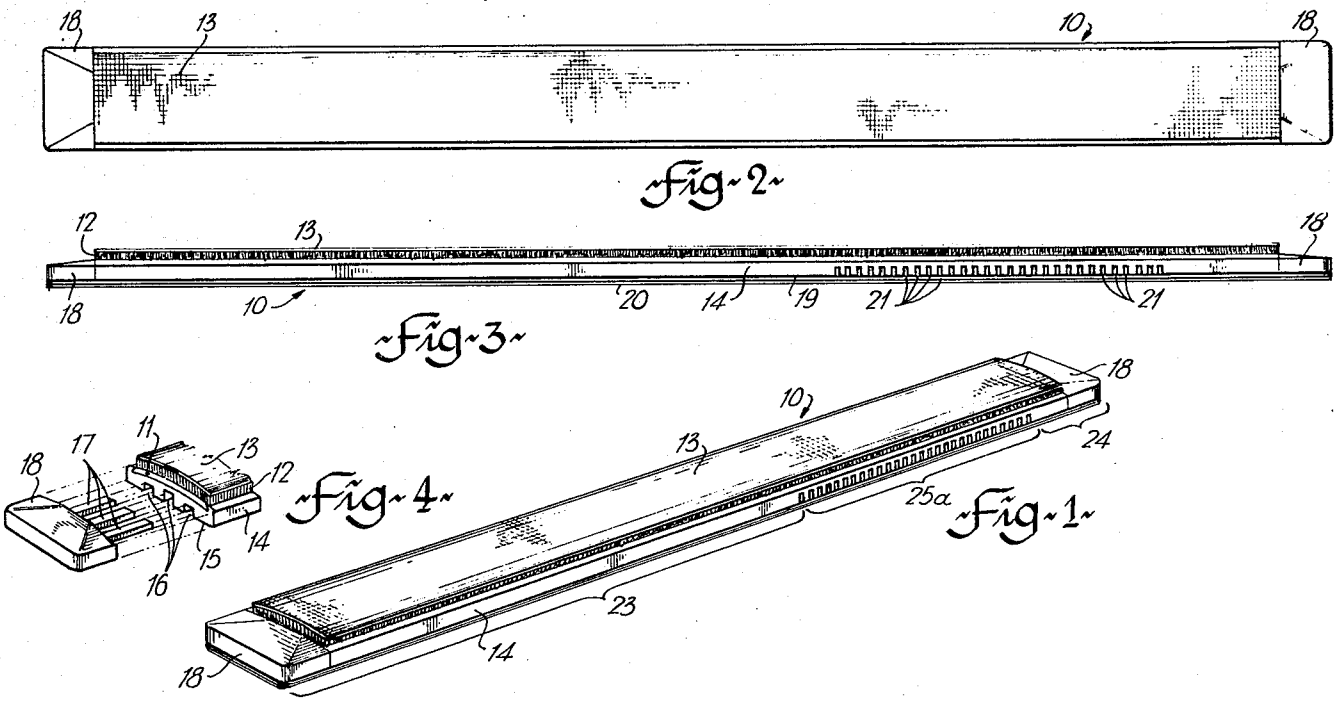
FIG. 1 is a prospective view of a flexible holder member according to the present invention.
FIG. 2 is a plan view thereof.
FIG. 3 is side view thereof.
FIG. 4 is an exploded perspective view of the end portion of the holder member of FIG. 1 showing how the end caps of the holder member are centered in position.

Turning firstly to the holder means of FIGS. 1–4, the holder member 10 forms a vital portion of the holder means according to this invention. It is of an elongated, flat, flexible type and comprises a first plastics base 11 to which is fixedly secured, during the molding of base 11, a first part 12 of interlocking fiber tab means such as the well known "VELCRO" (trade mark) fastener. In the presentation of FIGS. 1–4, the first part 12 of the fastener is shown in association with a second part 13 of the fastener it being understood that the second part 13 is normally secured to the shower curtain as referred to hereinafter. The first base 11 is received in a longitudinal groove of a second plastic base 14, as best seen in FIG. 4. It is also shown in FIG. 4, that both the first plastic base 11 and the bottom of the groove in base 14 are both slightly convexly curved to give the top surface of part 12 of the fastener a correspondingly convex shape, to facilitate engagement and disengagement of the tab means.

The holder member as shown in FIGS. 1–4, in general terms, thus has its top surface provided with at least a portion of the second tab means as referred to hereinbefore and hereinafter, it being understood that the continuous arrangement of the holding means as shown in FIGS. 1–4 is preferable.

The second plastic base 14 has a base surface 15 (FIG. 4) in which are arranged three longitudinal grooves 16 which are arranged to snugly receive prongs 17 of an end cap 18. The embodiment of FIGS. 1–4 has one end cap 18 at both ends of the second plastic base 14. It will be appreciated that with caps 18 in position, the surface of the caps is flush with the associated surface portions of the second plastic base 14.

The base surface 15 of the second plastic base 14 is provided with a strip 19 of a material available on the market under the trade mark MACTAC. Basically, it is a plastics foam whose both surfaces are provided with a pressure sensitive adhesive, one of the two faces having a protective, non-adhesive strip-off cover. It will be seen that the strip 19 extends the entire length of the holder member 10 inclusive the end caps 18. The protective strip is designated with reference numeral 20 (FIG. 2).

Figure 7:
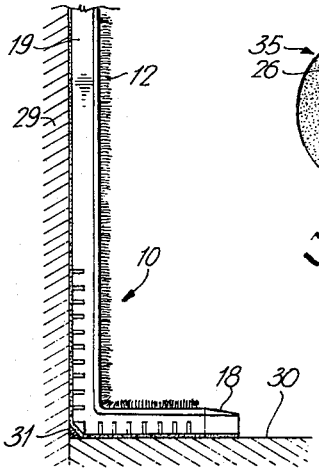
FIG. 7 is a detail in side view showing how the holder member of FIG. 1 is secured to the respective portions of the shower compartment.

A plurality of transverse grooves 21 is provided in the base surface 15 and divides the entire length into three sections, the section to the left of the grooves 21 in FIG. 3 being referred to as a first section, the part containing the transverse grooves 21 being designated as third section and finally, the terminal portion to the right of the third section being referred to as a second section. The purpose of the grooves 21 is to increase flexibility of the third section for facilitating the securing of the entire member 10 to the wall and to the rim as shown in FIG. 7. The first, second and third sections are designated with reference to numerals 23, 24 and 25 (FIG. 1).

Figure 6:
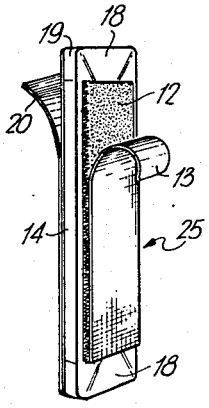
FIG. 6 is a perspective view showing the arrangement of an auxiliary holder member.

Turning now to FIG. 6, it will be seen that the auxiliary holder member shown in that figure is of generally the same structural arrangement as that in FIGS. 1–4, the difference being in the overall length and in the absence of grooves 21 in the holder member of FIG. 6. Therefore, the components of the member in FIG. 6 are referred to with the same reference numerals as used in FIGS. 1–4. The auxiliary member in FIG. 6 as a unit is referred to with reference numeral 25.

Figure 8:
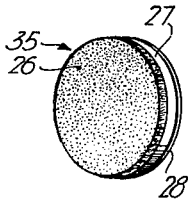
FIG. 8 is a perspective view disclosing a first part of the fiber interlocking tab on the preferred embodiment of FIG. 5.

FIG. 8 shows preferred embodiment of the first part of the fiber interlocking tab arranged for securing to the curtain of the shower compartment. It comprises interlocking surface 26 generally identical with the surface of second part 13 in FIGS. 1 and 6, facing the first part 12. The interlocking surface 26 is provided with a foam base 27 whose bottom face is covered by a protective sheet 28, the portions 27 and 28 being generally identical with the strip of foam 19 and protective strip 20 as referred to above.

Turning back to FIG. 4 (which does not show the foam 19 and protective cover 20 for the sake of clarity) and with particular reference to the material from which the first plastic base first is made as compared with the material of the second plastic base 14, it will be appreciated that prior to installation of member 10, the member is first bent to conform to the shape of the corner between a compartment wall 29 (FIG. 7) and a bath tub rim 30. The bending is facilitated by the lines of weakness provided by grooves 21. Due to the increased shape memory of the first plastic base 11, the entire member 10 retains for some time the bent shape even though the more resilient material of the second plastic base 14 tends to return the whole base to a straight tape as shown in FIG. 1. A small piece of sealant 31 is placed in the corner between the wall 29 and rim 30. Subsequently, the backing strip 20 is removed from the bent member 10 and the entire member 10 is now ready to be attached to the wall and to the adjacent portion of the rim substantially as shown in FIG. 7 or in FIG. 5.

The tab of FIG. 8 is then secured to the appropriate portions of the shower compartment curtain as referred to hereinafter. If desired, the auxiliary member 25 is also secured to the wall 29 following the removal of its backing strip 20.

Figure 5:
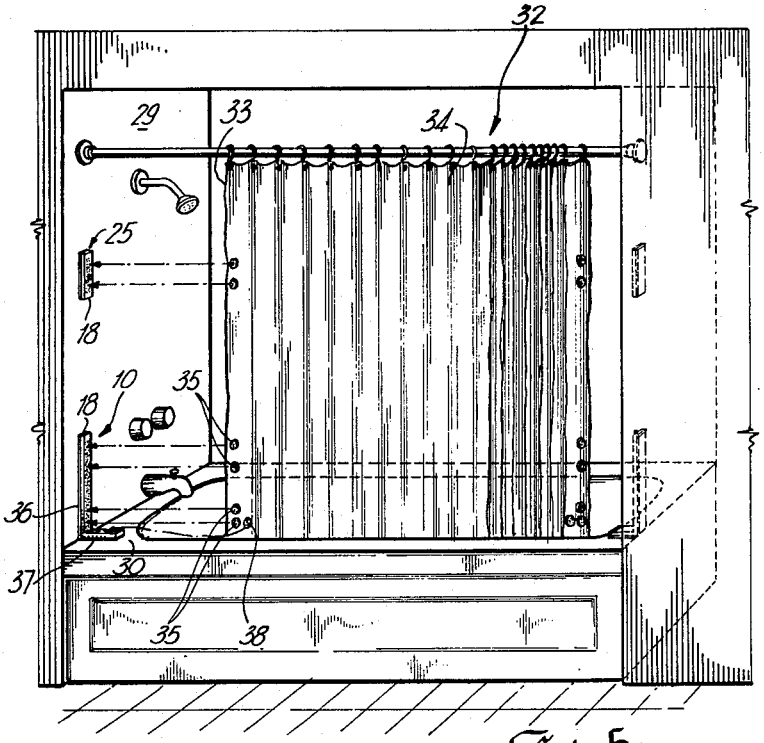
FIG. 5 is a perspective view of preferred embodiment of the present invention as installed.

At the same time, the appropriate counterparts of the fastener are secured to the curtain as best seen in FIG. 5. It is to be appreciated at this point that even though the member in FIG. 8 is shown as having a foam backing 27 with protective strip 28, such arrangement is indicated strictly for the sake of clarity. Many other obvious ways exist in the art for fixing the circular tabs to the curtain.

With particular reference to FIG. 5, it will thus be appreciated that the present invention provides a device for preventing water escape from a shower compartment 32 by releasably securing at least one end 33 of a shower curtain 34 to a bath tub compartment wall (i.e. wall 29). As mentioned above, the device utilizes interlocking fiber tab means whose first part in the form of circular tabs 35 is fixedly secured to the curtain for releasably engaging a second part of the tab means associated with members 10 and 25. The holder means 10 which secures to the wall 29 the second part of the tab means includes an elongated, flat, flexible holder member as described above whose top surface is provided with the second tab means, as shown. As shown in FIG. 7 and FIG. 5, the base surface 15 of the holder member 10 is adhesively secured to predetermined portions of the compartment 32 such that the holder member has a vertical portion 36 and a horizontal portion 37. Each of the horizontal and vertical portions 36, 37 carries the second part of the interlocking tab means.

The embodiment in FIG. 5 clearly shows that the first interlocking means is arranged such that one part of the tabs 35 is secured to the outside face of the curtain adjacent to but spaced from the front end 33 of curtain 34. The tabs 35 thus engage the vertical portion 36 of holder 10. On the other hand, the additional tab 38 is horizontally spaced from the generally vertical line of arrangement of tabs 35 such that it is capable of interlocking with the second tab portion associated with the horizontal part 37 of member 10.

The basic concept of the present invention resides in the provision of a flat member such as member 10, arranged to be fixed both to the vertical wall 29 and to the horizontal rim 30. The curtain 34 thus forms a corner structure in itself which effectively directs shower water back into the bath tub. The small amount of water that might get by such preformed bottom end of the shower is effectively stopped by the foam layer 19 and by the sealant 31.

The present invention thus provides for a simple, inexpensive and eye appealing arrangement which is superior to the above prior art not only from the standpoint of manufacture and installation but also from the standpoint of safety of the eventually installed arrangement.

Those skilled in the art will readily conceive many further modifications of the embodiment as described.

Some of such modifications have already been mentioned above and include the replacement of circular tabs 35 with a continuous strip sewn to the curtain. Similarly, even though the first part 12 associated with holders 10 or 25 is shown as being separate for each of two members, it is readily conceivable that by removing the adjacent end caps 18 (as marked in FIG. 5) it is possible to use a continuous interlocking strip 12 throughout the entire height of the assembly as shown in FIG. 5. Even though two separate members 10, 25 are preferable, it is obvious that such embodiment may be replaced by a single strip which would preferably have the vertical portion 36 somewhat higher than shown in the drawing. It is irrelevant from the standpoint of the scope of the present invention whether the above arrangement is provided at merely one or both end walls of the compartment 32 (as marked in broken lines).

The embodiments of the invention in which an exclusive property or privilege is claimed are defined as follows:

1. A device for preventing water escape from a shower by releaseably securing at least one end of a shower curtain to a wall of a bath tub compartment, said device being of the type utilizing releasably interlocking fiber tab means having a first part and a second part, said first part being arranged to be secured to the curtain; said device comprising holder means for securing to said wall said second part of the tab means; said holder means including an elongated, generally flat, flexible holder member having a top surface provided with at least a portion of said second tab means; said holder member having a base surface provided with means for adhesively securing said base surface to said wall; said base surface having a first section arranged to be secured to said wall along a generally upright line; a second section arranged to become secured to the rim of the bath tub in a generally horizontal position, in proximity to said generally upright line; and a third section integral with said first section and with said second section, said third section being located between said first section and said second section and being arranged to become secured to a corner portion defined by said wall and by said rim near said generally upright line and said third section further including weakening means whereby flexibility of said third section is increased.

2. A device as claimed in claim 1 wherein said second part of the tab means is an interlocking tab tape fixedly secured to a first plastics base, said first plastics base being snugly received in a longitudinal groove provided in the top surface of a second plastics base, the plastics bases being produced from different materials such that the shape memory of said first plastics base is greater than the shape memory of said second plastics base.

3. A device as claimed in claim 1 wherein said top surface is slightly convexly curved, whereby said second part of said tab means protrudes from the top surface of the holder member in a slightly convexly curved fashion.

4. A device as claimed in claim 1, wherein said first part of said tab means is fixedly secured to the surface of said curtain turned away from said compartment, in proximity to but spaced from the edge of said curtain adjacent to said wall; said first part of said tab means being arranged along a generally vertical line and including at least one additional tab horizontally spaced from generally vertical line, whereby said first tab means is capable of engagement with the second part of said tab means both in the generally vertical and in the generally horizontal portions of said holder means.

5. A device for preventing water escape from a shower by releasably securing at least one end of a shower curtain to a wall of a bath tub compartment, said device being of the type utilizing releasably interlocking fiber tab means having a first part and a second part, said first part being arranged to be secured to the curtain; said device comprising holder means for securing to said wall said second part of the tab means; said holder means including an elongated, generally flat, flexible holder member having a top surface provided with at least a portion of said second tab means; said holder member having a base surface provided with means for adhesively securing said base surface to said wall; said base surface having a first section arranged to be secured to said wall along a generally upright line; a second section arranged to become secured to the rim of the bath tub in a generally horizontal position, in proximity to said generally upright line; and a third section integral with said first section and with said second section, said third section being located between said first section and said second section and being arranged to become secured to a corner portion defined by said wall and by said rim near said generally upright line; and, said second part of said tab means includes an interlocking tab tape fixedly secured to a first plastics base, said first plastics base being snugly received in a longitudinal groove provided in the top surface of a second plastics base, the plastics bases being produced from different materials such that said first plastics base has a greater shape memory than the shape memory of said second plastics base.

6. A device as claimed in claim 5, wherein said second plastics base includes an end cap arranged to abut with the abutting face against one end of the second plastics base; said cap and said end of the plastics base including means for centering said cap with respect to said second plastics base such that the cap is generally flush with the surface portions of said second plastics base, a portion of the abutting face being arranged to form one end of said longitudinal groove.

* * * * *